United States Patent [19]

Myers

[11] Patent Number: 5,057,045

[45] Date of Patent: Oct. 15, 1991

[54] WATER SKI BRAKE

[76] Inventor: James R. Myers, 237 Robin Rd., Altamonte Springs, Fla. 32701

[21] Appl. No.: 611,719

[22] Filed: Nov. 9, 1990

[51] Int. Cl.[5] ..... B63B 35/81

[52] U.S. Cl. ..... 441/79; 114/145 R; 114/170

[58] Field of Search ..... 114/170, 171, 145 R, 114/127, 140, 153; 441/68, 79, 71, 72, 65, 77, 70; 180/270

[56] References Cited

U.S. PATENT DOCUMENTS

| | | | |
|---|---|---|---|
| 1,500,584 | 7/1924 | Harley | 114/145 R |
| 3,145,399 | 8/1964 | Jackson | 441/72 |
| 4,710,144 | 12/1987 | Hunt | 441/79 |
| 4,775,344 | 10/1988 | Anderson | 441/68 |

FOREIGN PATENT DOCUMENTS

| | | | |
|---|---|---|---|
| 194765 | 1/1958 | Austria | 441/79 |
| 1123717 | 11/1984 | U.S.S.R. | 441/68 |

*Primary Examiner*—Sherman Basinger
*Attorney, Agent, or Firm*—William M. Hobby, III

[57] ABSTRACT

A water ski brake apparatus includes a water ski having a tip, a tail, and a top and bottom, and having a vane attached to the bottom of the water ski. The water ski has a ski boot having a toe and heel with the front of the heel being hingedly attached to the top of the water ski. A drag inducing foil is movably attached to the vane in a predetermined position thereon and is shiftable between first and second angular positions. A linkage is attached to the boot heel at one end and to the drag inducing foil at the other end and is shiftable between a first and second position responsible to movement of the boot heel on the boot hinged to shift the drag inducing foil between first and second positions to thereby brake the water ski by increasing the drag when the drag inducing foil is shifted to a second position in the water at the control of the skier by varying his weight distribution in the heel portion of the boot.

7 Claims, 2 Drawing Sheets

WATER SKI BRAKE

BACKGROUND OF THE INVENTION

The present invention relates to water skis and especially to a water ski braking member for braking the ski in the water responsive to a skier shifting his weight on the ski.

Water skiing is a popular sport in which a skier is towed behind a motor boat with his feet positioned on one or two skis. A tow rope connected to the boat has a handle portion on the back thereof which is held by the water skier so that he can be pulled through the water on the skis. Water skis come in different types including conventional twin skis in which the skier has one foot on each of a pair of skis. Each ski typically has a front or tip portion, a back or tail portion, and a ski binding or boot attached to the top of each ski. The bottom of each water ski frequently has a vertically extending fin to provide better control during the skiing. The boot may have a toe and a heel. In addition to twin skis, skis are also made as a mono-ski in which the skier rides on one ski and has a front binding and a back binding for putting each of the feet on the ski. A figure ski may have two bindings while a jump ski may be shaped differently for riding the ski over a jump.

Manufacturers of quality water ski equipment have attempted over the years to meet the high performance needs of competition skiers, professionals and advanced amateurs in the sport of slalom water skiing. This includes the use of exotic materials and advanced aerodynamic features incorporated into the design of the slalom ski which have helped meet the ever increasing demand for higher performance. These efforts have led to various composite materials, concave and complex shaped ski bottoms, specially designed fins and foils, and sophisticated ankle and foot supporting boots. However, the skier has a limitation of how fast he can accelerate across the wake behind the boat toward the next buoy and how quickly he can decelerate in a controlled manner to set up for the turn.

The present invention is directed to give a skier greater decelerating capability when setting up for a turn at a buoy so that the skier can concentrate on quicker acceleration out of the turn and is thereby motivated to achieve higher speeds crossing the wake. This is accomplished in the present invention by a skier controlled or active braking system which significantly increases the braking drag capability only as needed by the skier. Thus, the present invention is directed towards an active brake system for a water ski which allows the brake to be shifted between two positions sensitive to the body position and weight distribution of the skier on the ski. It therefore shifts a hydrofoil brake on the rear fin on the water ski.

In the prior U.S. Pat. No. 3,103,673, to Martin, Jr., an early water ski attachment is illustrated for stabilizing a water ski which has a vane having a brake placed at an angle such that the brake can be shifted by shifting the angle of the water ski. In the Estes U.S. Pat. No. 3,082,444, a water ski safety skag is shifted into and out of the water. In the Anderson U.S. Pat. No. 4,775,344, a method and apparatus for steering a water ski has a vane protruding beneath the water ski and a gear linkage mechanism which allows the rear foot to shift the angle of the vane for steering the water ski.

SUMMARY OF THE INVENTION

A water ski brake apparatus includes a water ski having a tip, a tail, and a top and bottom, and having a vane attached to the bottom of the water ski. The water ski also has a ski boot having a toe and heel with the front of the heel being attached to the top of the water ski. A drag inducing foil is movably attached to the vane in a predetermined position thereon and is shiftable between first and second angular positions. A linkage is attached to the boot heel at one end and to the drag inducing foil at the other end and is shiftable between a first and second position responsive to movement of the boot heel on the boot hinge to shift the drag inducing foil between first and second positions to thereby brake the water ski by increasing the drag when the drag inducing foil is shifted to a second position in the water at the control of the skier shifting weight distribution and feet in the boot. The hinged boot heel can be spring biased to one position and may be connected to a flexible or rigid link member extending to the tail portion of the ski. The link member can shift a bell crank arm to move a sliding link extending through the ski and attached to the drag inducing foil member. The bell crank can be spring loaded and attached to a supporting brace member on top of the water ski.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
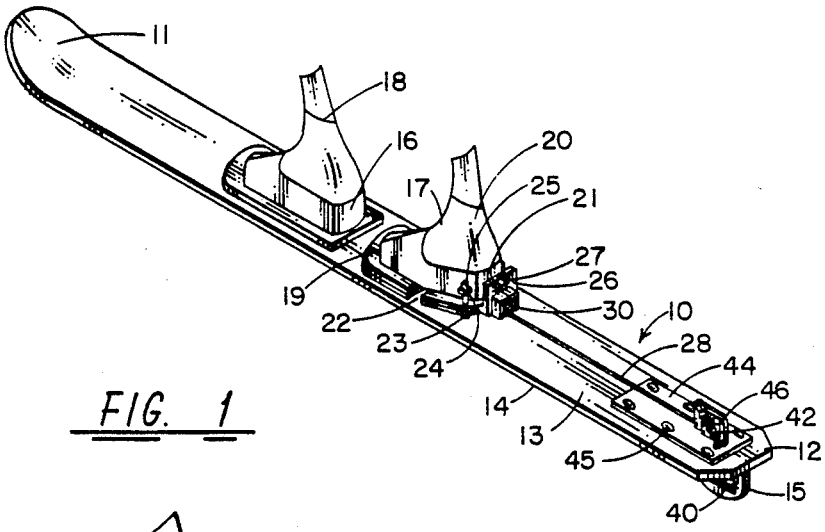
FIG. 1 is a perspective view of a slalom ski with the ski brake in accordance with the present invention.
Figure 2:
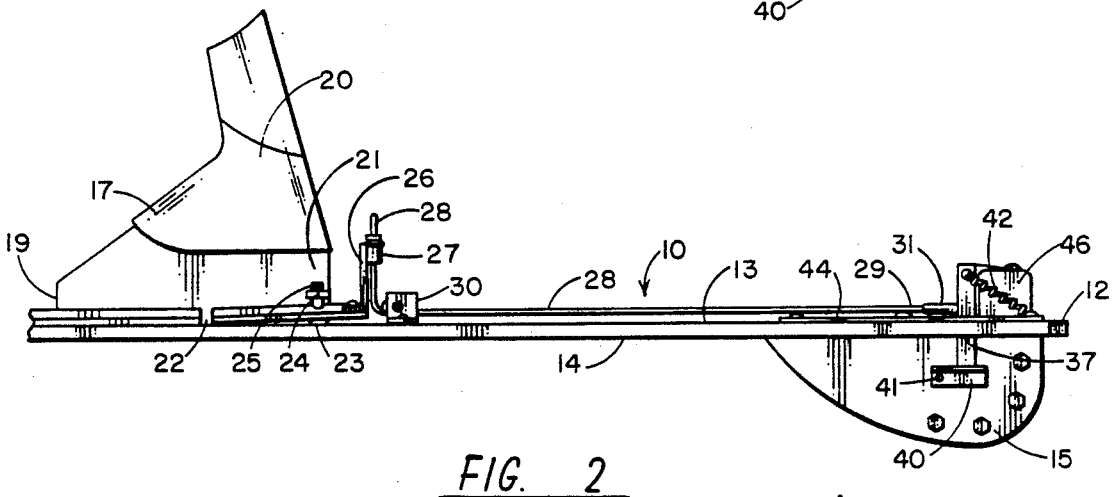
FIG. 2 is a partial side elevation of the water ski of FIG. 1.
Figure 3:
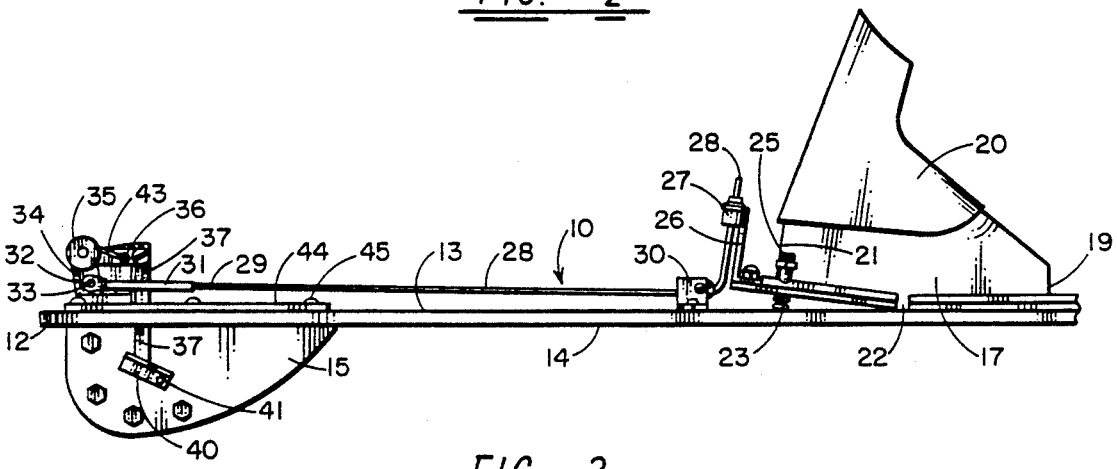
FIG. 3 is an opposite side elevation of the water ski of FIG. 2.
Figure 4:
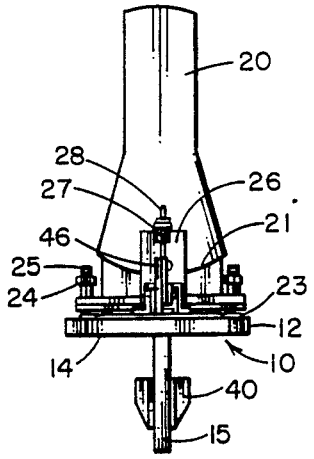
FIG. 4 is a rear elevation of the water ski of FIGS. 1–3.
Figure 5:
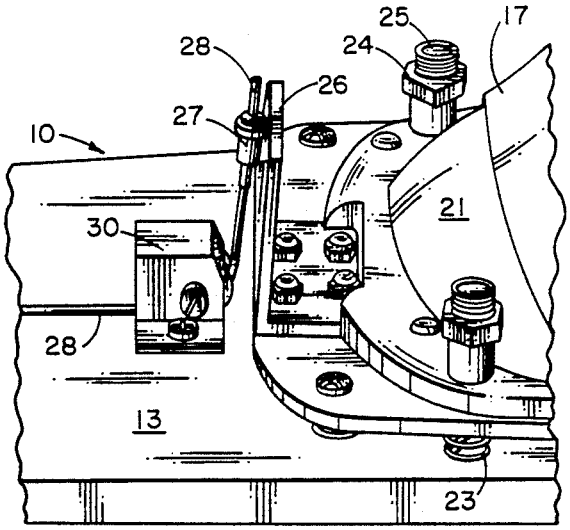
FIG. 5 is a partial perspective on an enlarged scale of a linkage connection of the water ski of FIGS. 1–4.

Referring to the drawings and especially to FIGS. 1 and 2, a water ski 10, which is illustrated as a slalom water ski, has a tip 11, a tail 12, a top 13, and a bottom 14. The bottom 14 has a vertically extending fin or vane 15 adjacent the tail portion 12 of the water ski 10. The water ski has a front boot 16 and a rear boot 17 showing a skier's foot 18 in a front boot and a skier's foot 20 in the rear boot 17. The rear boot 17 has a toe portion 20 and a heel portion 21 and has a hinge 22 on the front of the heel 21. The heel portion 21 is hinged at 22 and has a spring 23, as shown in FIG. 3, holding the heel portion in a raised position. A pair of springs 23 may be adjusted by the rotation of a nut 24 on a bolt portion 25 to adjust the raised height of the rear of the heel portion 21. The boot 17 heel portion 21 has a bracket 26 thereon having a cable linkage binding 27 attached thereto for anchoring the end of a cable 28. A pulley bracket 30 and pulley are attached to the top 13 of the ski 10 and allows the linkage cable 28 to pass therearound. The opposite end of the cable 22 has a cable leader portion 31 which may be swaged onto the end of the cable and has an eyelet portion 32 attached to a pin 33 on a bell crank arm 34, as shown in FIG. 3. The bell crank arm is attached to a shaft 35 which also has a linkage member 36 attached thereto.

The linkage member 36 is attached to a sliding link 37 which in turn is connected to the drag inducing foil member 40, shown in FIG. 3 in a drag position and in FIG. 2 in a non-drag position. Drag foil 40 is pinned with a pin 41 to the vertically extending fin or vane 15 and is shifted between first and second positions by the sliding link 37. Sliding link 37 is spring loaded with a spring 42 in FIG. 2 and a coil spring 43 may wrap around the shaft portion 35. Thus, the springs 42 and 43 along with the springs 23 holding the heel 21 of the boot 17 in a raised position counterbalance each other to always keep the linkage cable 28 taunt.

Figure 6:
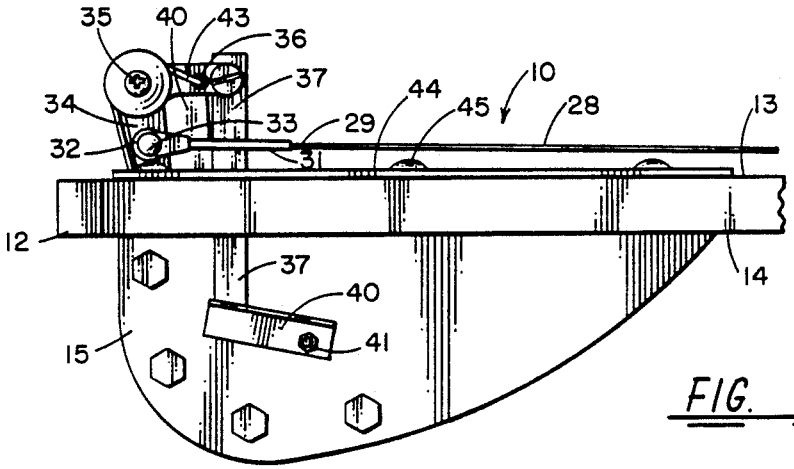
FIG. 6 is a side elevation on an enlarged scale of a portion of the linkage mechanism of the water ski in FIGS. 1–5.
Figure 7:
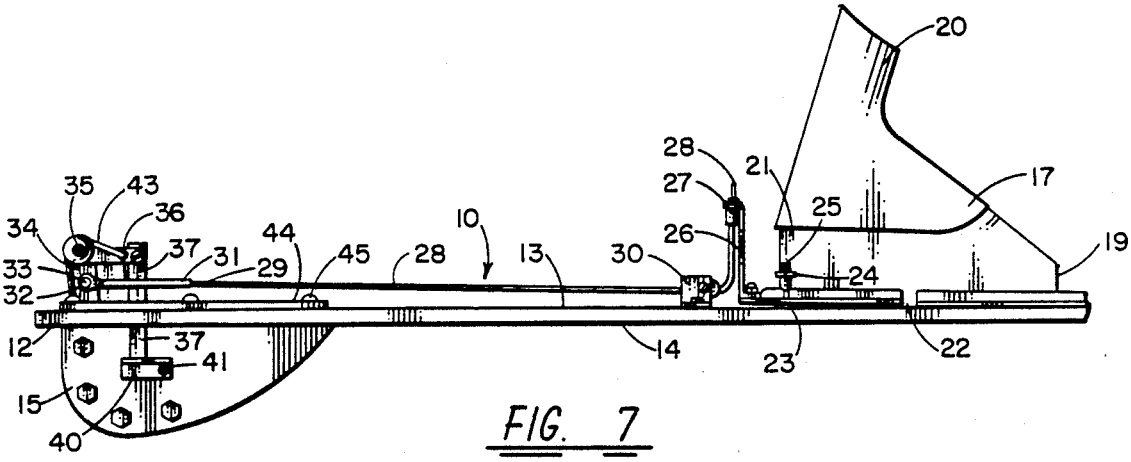
FIG. 7 is a side elevation of a portion of the water ski showing the drag foil in FIG. 6 in a second position.

When the skier shifts his foot 20 and shifts his weight onto the heel 21, he pushes against the spring 23 and pulls the cable 28 to release the linkage 28 and thereby position the foil, as shown in FIG. 7. When the heel is raised by taking the weight off the heel 21, the spring moves the foil 40 to a second position, as shown in FIGS. 3 and 6. A linkage supporting base plate 44 is anchored to the top 13 of the ski 10 with a plurality of screws 45 and has an upwardly extending linkage support member 46 for supporting the linkage 32, 35, 43 and one end of the sliding link member 37.

The skier activates the brake foil 40 to shift the foil 40 into a laminar flow interrupting foil to significantly increase the ski drag. During normal operation, the brake foil 40 is in a position generally parallel to the bottom 14 of the ski 10. Under braking conditions, after the skier has passed over a boat wake during a turn, the skier naturally leans forward forcing more ski contact with the water and this natural body position results in the heel of the foot 20 located on the rear end of the slalom ski in the boot 17 to raise which, under the spring 23, lifts the rear heel portion to thus shift the foil 40 in the position shown in FIGS. 3 and 6 to raise the foil at an angle as it passes through the water to a predetermined angle to thereby automatically produce a drag with the natural shift of the skier's weight and rear foot. When the skier is ready to accelerate, he leans backwards and the resulting force of the foot in the boot 17 shifts the hinge heel portion 21 on the slalom ski pushing the ski boot assembly into the normal position, as shown in FIGS. 2 and 7, to allow the ski to accelerate.

It should be clear at this time that a water ski brake has been provided for a slalom ski which brakes by the natural leaning of the skier's body at the points where the skier normally desires to brake the ski and then shifts to allow the ski to accelerate at the proper shifting of the skier's weight. However, the present invention is not to be construed as limited to the forms shown which are to be considered illustrative rather than restrictive.

I claim:

1. A water ski brake comprising:

a water ski having a tip, a tail, and a top and a bottom and a vane attached to the bottom thereof, said water ski also having a ski boot having a toe and heel and the boot heel being hingedly attached at the toe to the top of said water ski;

a drag inducing foil movable attached transversely to said vane in a predetermined position thereon and shiftable between first and second positions, each position of said drag inducing foil being at a different angle to said vane; and linkage means attached to said boot heel at one end and to said drag inducing foil at the other end and shiftable between first and second positions responsive to the movement of said boot heel on the boot hinge to shift said drag inducing foil between said first and second positions to thereby brake the water ski by increasing the water drag when said drag inducing foil is shifted to said second position in the water at the control of the skier shifting one foot in said boot.

2. A water ski brake in accordance with claim 1 in which said water ski has a spring mounted between the top thereof and the bottom of said boot heel to thereby bias said heel away from said water ski top.

3. A water ski brake in accordance with claim 2 in which said water ski boot has a linkage support bracket attached thereto and having one end of said linkage means attached thereto.

4. A water ski brake in accordance with claim 3 in which said water ski linkage means includes a cable attached to said linkage support bracket at one end and to a linkage crank member at the other end thereof.

5. A water ski brake in accordance with claim 4 in which said water ski has a second linkage support bracket attached to the top thereof adjacent the tail of said water ski and said second linkage support bracket having said crank member pinned thereto.

6. A water ski brake in accordance with claim 5 in which said water ski linkage means crank member is an elbow crank member having a pair of arms and having said cable attached to one arm thereof.

7. A water ski brake in accordance with claim 6 in which said water ski linkage means includes a slide link member attached at one end to the other arm of said elbow crank member and is attached to said drag inducing foil at the other end thereof whereby movement of said slide link member by said elbow crank will move said drag inducing foil between said first and second positions to thereby brake said ski or to release the braking of said ski.

* * * * *